United States Patent [19]

Nissen

[11] 4,008,892

[45] Feb. 22, 1977

[54] APPARATUS FOR REBOUND RUNNING

[75] Inventor: George P. Nissen, Cedar Rapids, Iowa

[73] Assignee: Nissen Corporation

[22] Filed: Aug. 7, 1975

[21] Appl. No.: 602,683

Related U.S. Application Data

[63] Continuation of Ser. No. 338,190, March 5, 1973, abandoned, which is a continuation-in-part of Ser. No. 262,679, June 14, 1972, abandoned.

[52] U.S. Cl. ..... 272/100; 272/102; 272/4

[51] Int. Cl.[2] ..... A63B 5/08

[58] Field of Search ..... 272/59 R, 59 C, 65, 272/4; 273/26 A, 1 R, 29 A, 1.5 R, 1.5 A, 102 R, 102 S, 95 R, 95 H

[56] References Cited

UNITED STATES PATENTS

| | | | |
|---|---|---|---|
| 2,165,749 | 7/1939 | Engholm et al. | 272/59 A |
| 3,024,022 | 3/1962 | Goyette | 272/59 C |
| 3,502,330 | 3/1970 | Cheftel | 273/1 R |

*Primary Examiner*—Richard C. Pinkham
*Assistant Examiner*—William R. Brownie
*Attorney, Agent, or Firm*—Haven E. Simmons; James C. Nemmers

[57] ABSTRACT

A runner traverses a long distance by running back and forth over a short pathway or lane laid out on a floor and at each end of the lane reverses his direction by partially turning just before striking one of a pair of resilient backstops, each pair having an inverted U-shaped frame, placed at the ends of the lane. In other cases a backstop may be used at one end only of the lane, the runner thus traversing the lane only twice. Each backstop, due to its angle with the floor, rebounds the runner back in the opposite direction at substantially the same speed at which he struck the backstop. In these manners and with such apparatus not only can longer distances be effectively run over relatively short lengths of gymnasium floor, for instance, but various types of foot races can also be conducted indoors.

10 Claims, 3 Drawing Figures

APPARATUS FOR REBOUND RUNNING

CROSS REFERENCE TO RELATED APPLICATIONS

This application is a continuation of application Ser. No. 338,190, filed Mar. 5, 1973, now abandoned, which was a continuation-in-part of application Ser. No. 262,679, filed June 14, 1972, now abandoned.

BACKGROUND OF THE INVENTION

There has been no really satisfactory manner in which long distances can be effectively run indoors, such as in a typical school gymnasium. In some gymnasiums, an overhead track is disposed above the floor around the walls, being hung from the latter and the ceiling. These are not only expensive to install but they are also not very satisfactory for a number of reasons. First, they are necessarily relatively narrow in width and cannot easily accommodate many runners at the same time. Second, they are curved at the corners and banked in order to enable the runners to maintain speed, whereupon it becomes difficult to keep to a prescribed course through the turns, especially if several runners are competing at once. Third, as a consequence of the latter aspect, the actual distance run can vary significantly during the longer races, depending upon whether the runner is up or down on the banking through a corner, particularly since the straight portions between the corners are relatively short.

Running about the perimeter of the gymnasium floor is even less satisfactory inasmuch as there is no ready means of banking the corners which limits running speeds pretty much to a "jogging" pace. Furthermore, that expedient often interferes with use of the floor for other purposes. Short, straight line "sprint" types of contests, a 20 yard dash, for instance, have sometimes been conducted in gymnasiums but these are hard on the runners, even dangerous, because they must get up to and maintain maximum speed throughout the course and then come to a full stop as soon as possible to avoid colliding with a wall. Even when wall padding or large cushions or bales are placed at the ends of the course, injury can occur. In any event, the proximity of such obstructions must surely sometimes act as a psychological impediment to the runner, causing him to "let up" a bit near the end of his sprint.

Beginning some years prior to the present invention, "races" have sometimes been run on trampolines. This was instigated by the present inventor and is done on a trampoline, otherwise in conventional form, equipped with resilient backstops at the ends of the bed, such as the backstops shown in U.S. Pat. No. 3,339,925. The contestants run back and forth on the trampoline bed between the backstops, using the latter to reverse their direction at each end of the bed. This, not surprisingly, has several serious limitations. In the first place, it is practical only for children because the speed and weight of adults striking the backstops invariably tends to move the entire apparatus around on the floor. In the second place, the resilient suspension of the bed interferes with running in the sense of that on a relatively non-yielding or unsuspended surface. In the third place, the distance between the backstops is too short; even in the case of the largest trampolines it is only about 22 feet and this is simply not enough in order to run or race effectively in the sense that that is done on the ground. And in the fourth place, since the trampoline bed is elevated, there is always the chance of injury. The present invention was conceived in connection with possible modifications of a trampoline to make it more suitable for running "races" but was not actually tried out at the time because no one felt it would be feasible. When finally tried, with two backstops from a trampoline spaced apart on and anchored to a gymnasium floor, it succeeded beyond all expectations. Apparatus was thus provided by which distances of almost any length could be effectively run, by a single runner or by a group of runners competing with each other, within the confines of a typical gymnasium.

SUMMARY OF THE INVENTION

A straight pathway on lane of some convenient length is first selected along a suitable portion of the gymnasium floor. The lane may be defined by a length of mat surface but this is not necessary. Across each end of the lane is placed a backstop having a large resilient panel preferably somewhat inclined away from the lane, the backstop being secured against movement. Distances greater than the length of the lane are run by sprinting back and forth over the lane a sufficient number of times to equal the greater distance. At each end of the lane the runner at full speed, just before he reaches the backstop, turns bodily so that his back strikes the panel. The panel itself is sufficiently large and resilient so that the runner is bodily rebound therefrom, facing in the opposite direction, at substantially the same speed at which he struck the panel. This technique, which is readily and quickly learned, is repeated at each end until the greater distance has been traversed or until the runner has covered whatever total distance he desires.

A single runner can employ the apparatus and technique simply for long distance running at any speed he wishes, or just for exercise, or for running a timed course. A shuttle relay race, or other race between two runners, can be conducted simply by the two running in opposite directions. By placing a hurdle across the lane intermediate the backstops, a hurdle race can be run, and if several lanes are laid out side by side, each with its own pair of backstops, various kinds of races of long length can be run between larger numbers of runners. Another version of the present invention, particularly suitable for shorter sprint type races and shuttle relay races, employs a backstop at one end only of the lane. If the length of the lane is, say, 50 or 60 feet, the backstop in effect doubles its length so that a longer expanse of gymnasium floor is not tied up or needed. Several of such arrangements may be used side by side, one for each contestant or team, as the case may be. In short, various adaptations of the invention enable most any kind of long or short distance running or racing to be readily accomplished within the confines of the normal sized gymnasium, something which, so far as is known, has never previously been able to be done effectively.

A major aspect of the present invention is that it provides a new indoor sport, an amalgamation of certain trampoline techniques and ordinary running or racing on foot. If it seems strange to conduct a foot race by reciprocally traversing a relatively short distance and reversing oneself in the foregoing manner, it should be remembered that that in essence is how all indoor swimming contests are managed. No one swims continually in the same direction but back and forth between opposite walls of the pool, reversing himself at each wall in well known fashion. There is no reason why foot races cannot be run in a similar manner indoors where otherwise they would be impossible owing to the spacial and other limitations mentioned above. The utility and advantages of the present invention will become even more apparent when viewed in connection with the drawings and the more detailed description which follows.

DESCRIPTION OF THE PREFERRED EMBODIMENTS

Figure 1:
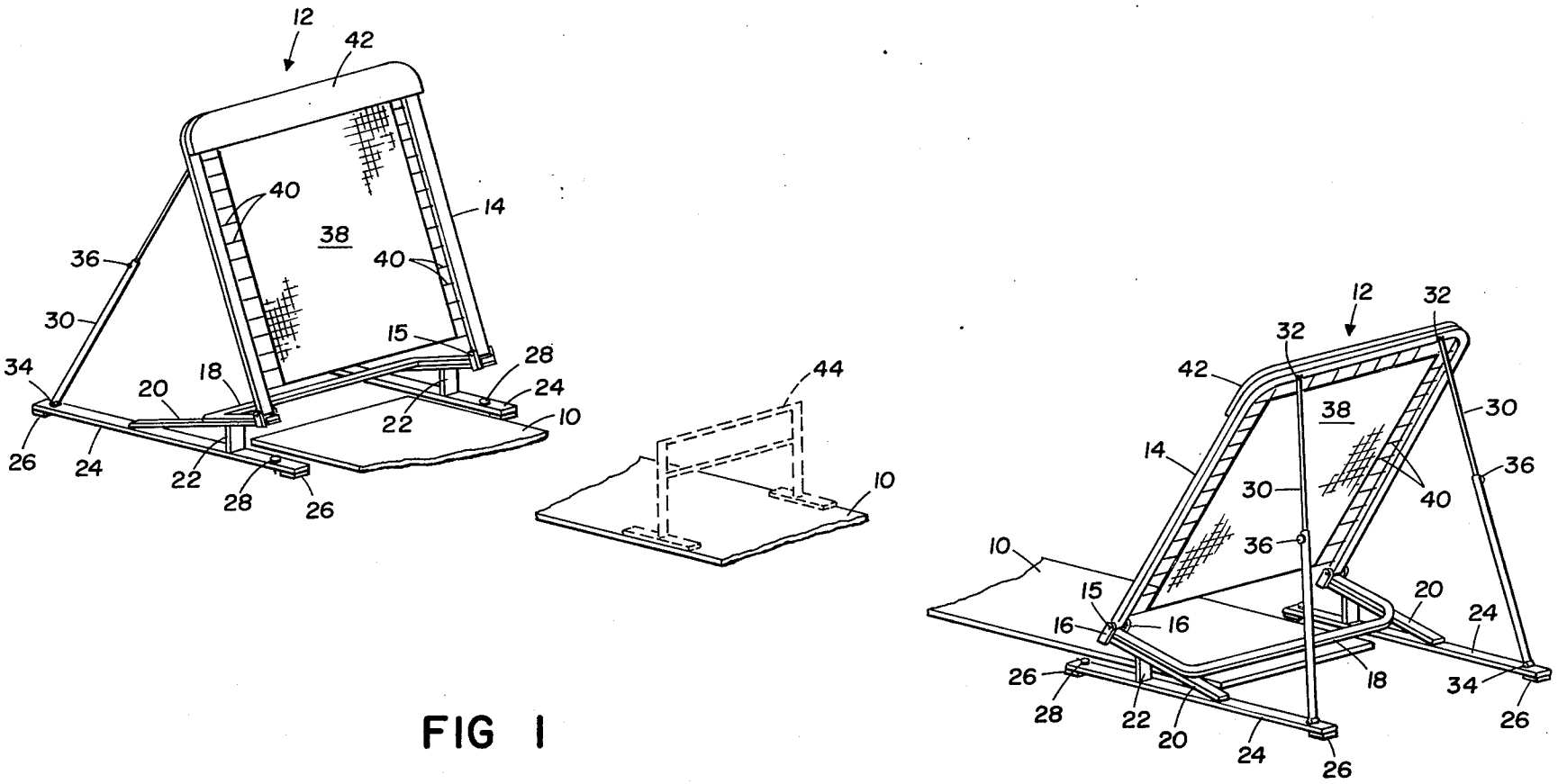
FIG. 1 is an isometric view of a pair of backstops according to the invention disposed at opposite ends of a single lane of a prescribed length, demarcated by a typical gym mat, laid out on a gymnasium floor.

A straight-a-way lane is laid out on the gymnasium floor of whatever length is convenient under the circumstances, say 60 to 120 feet. The bare floor itself can simply be marked off or the lane can be defined by a length of mat 10 of any suitable kind, the backstops 12 being placed transversely across each end of the mat 10. Each backstop 12, in the form illustrated, is essentially an adaptation of those shown in U.S. Pat. No. 3,339,925 for use with trampolines and designated in that patent by the reference numeral 20. These consist of inverted, U-shaped frames 14, formed from flattened steel tubing, which straddle the respective ends of the mat 10. Each lower end of the frames 14 is transversely pivoted at 15 to the upper ends of a pair of short plates forming a clevis 16. Between the lower ends of the respective pairs of cleves 16 are secured the ends of U-shaped yokes 18, also of flattened steel tubing, which extends well rearwardly from the opposed faces of the frames 14. The side members of each yoke 18 in turn lie upon and are clamped or otherwise suitably secured to a pair of short, intermediate rails 20, inclining rearwardly from the cleves 16, and supported in this position by being welded atop short vertical posts 22 intermediate the ends of the rails 20. The rear ends of the latter and lower ends of the posts 22 are welded in turn atop a pair of base rails 24 extending along and outboard of the sides of the mat 10. The ends of the base rails 24 are fitted with floor pads 26 and the forward ends of the former may be additionally equipped with floor screws 28 which removably engage suitable floor plates (not shown) anchored in the gymnasium floor, thus securing the backstops 12 against movement. The upper end of each frame 14 is supported by a pair of telescoping legs 30, transversely pivoted at 32 to the top member of the frame 14 and removable transversely pivoted at 34 to the rear ends of the base rails 24. Each leg 30 is fitted with a clamp 36 so that the inclination of the frames 14 can be adjusted relative to the floor about the pivots 15, 32 and 34. Within each frame 14 a flexible panel 38, similar to the bed of a trampoline, formed of open, interwoven strips of nylon fabric, is appropriately suspended from the frame top and side members by means of springs or resilient cord 40, also in the manner typical of trampoline beds, so that the panels 38 are tightly stretched within the frames 14. Since they would interfere with the runner's legs and feet, there cannot be any straight members between the lower ends of the frames 14 to brace the frame ends against the pull of the springs or cord 40. This is the function of the yokes 18 and they are carried rearwardly far enough to avoid any chance of them being struck by the runner's feet or legs. Across the tops of the backstops 12 are attached suitable pads 42 to protect the runner's head from the top members of the frames 14.

To use the apparatus, a runner may start at one end of the mat 10 just in front of its respective backstop 12 and sprint toward the other. Just before he strikes the latter backstop 12 he turns his body around toward the opposite direction. The panels 38 are of sufficient size and resiliency so that the runner is rebounded therefrom at substantially the same speed as that with which he struck them. As a working example each backstop 12 may have an overall height and width of about 10 feet and 8 feet, respectively, the panels 38 themselves being about 6 feet wide and 8 feet high. As the runner is rebounded by each panel 38, he is elevated somewhat owing to the inclination of the backstop 12. Inclination of the panels 38 from the vertical is not mandatory. It is helpful, however, if the included angle between the mat 10 and the panel 38 is more than 90° in order to elevate the runner enough on the rebound to enable him better to be "in stride" when his feet strike the mat 10, whence he can continue back along the mat 10 to the opposite end without any substantial interruption. Adjustment of the inclination of the panels 38, of course, is achieved by means of the telescoping legs 30 and clamps 36. The reversing procedure is repeated as many times as is necessary to complete whatever longer distance the runner is traversing, and is readily and quickly learned.

Figure 2:
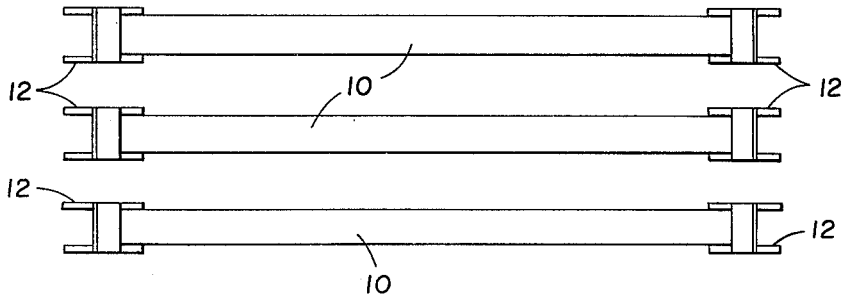
FIG. 2 is a plan view in somewhat diagrammatic form, of a layout of several such lanes disposed side by side for the conduct indoors of races between a number of runners.
Figure 3:
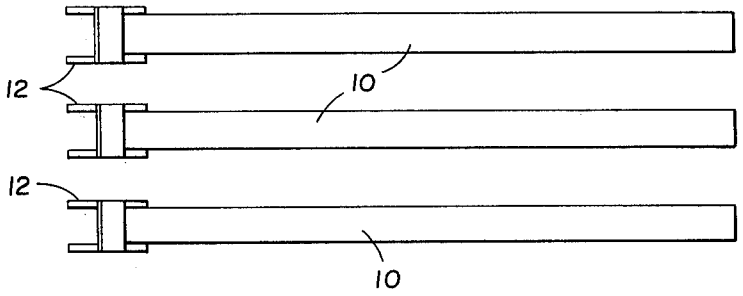
FIG. 3 is a somewhat diagrammatic plan view, similar to FIG. 2, of an arrangement of the invention employing several lanes side by side, but with backstops at one end only, which may be used for some types of races indoors.

By placing one or more, depending upon the length of the mat 10, hurdles 44 between the backstops 12, a hurdle race can be conducted. Two runners can use the apparatus at the same time by each starting midway along the mat 10 facing in opposite directions and then running toward the respective backstops 12, thus avoiding two runners at the same backstop at the same time. The runners merely pass each other in opposite directions in between as they race back and forth. A shuttle relay race can be conducted in the same manner, the baton being exchanged at the starting point midway along the mat 10. If different types of races are to be conducted at the same time, or one type of race between a larger number of runners is to be held simultaneously, several sets of the apparatus can be used side-by-side on the gymnasium floor as shown in FIG. 2, one set for each runner or in some circumstances for each pair of runners, whereby the mats 10 form a series of parallel lanes of equal length. In the case of shorter sprint type races, as well as shuttle relay races, the set-up shown in FIG. 3 may be used with a backstop 12 at one end only of the mats 10. The runners start at the free ends of the mats 10, reverse themselves at the other ends and finish at the free ends, exchanging the batons in the case of a relay race at the free ends. Each runner thus traverses a mat 10 only twice. As previously pointed out, even the single backstops 12 in effect double the length of the mats 10 and permit some types of races to be conducted in a relatively small area of the gymnasium when larger areas are not available or necessary. Experience has shown that in the case of the double backstop arrangements of FIGS. 1 and 2 the minimum feasible distance between the backstops is about 40 to 50 feet. In the case of that of FIG. 3, the minimum feasible length of the lane or mat has also proved to be about the same. With distances much less than these the running aspect is overwhelmed by the reversing aspect, becoming more a succession of turns than a race. The same would be true in the case of swimming if the length of the pool were below a certain minimum.

Accordingly, the apparatus of the present invention is very flexible and can be used and adapted for the conduct indoors of many types of running contests. At the same time, it is readily removed to clear the gymnasium floor for other activities simply by rolling up the mat 10 and detaching the floor screws 28. It will be understood, of course, that other methods of securing the backstops 12 can be used in place of the screws 28 and floor plates. The backstops 12 could, for instance, be braced against opposing walls of the gymnasium and weighted down to prevent them tipping. They are also easily stored simply by detaching the pivoted ends 34 of the legs 30 and folding the latter and the frames 14 down on the base rails 24.

Though the present invention has been described in terms of particular embodiments, being the best modes known of carrying out the invention, it is not limited to those embodiments alone. Instead, the following claims are to be read as encompassing all adaptations and modifications of the invention falling within its spirit and scope.

I claim:

1. A combination for use with a confined floor area for running a first distance longer than a second distance between two locations within said area by reciprocally traversing the second distance a plurality of times, the combination comprising: an unsuspended running surface, means on said surface defining a substantially rectilinear running lane, the lane having two locations thereon spaced apart longitudinally thereof and adapted to be reciprocally traversed by a runner; a backstop disposed at at least one of said locations, the backstop including a flexible panel and a frame surrounding margins of the panel, the panel being suspended within the frame by resilient means attached to and between the frame and said panel margins; and means supporting the frame against movement relative to the lane and with a face of the panel disposed in an upright position transversely of the lane, the panel being so angled with the running surface that when said face thereof is struck by an upright portion of the body of a runner running in one direction along the lane toward the backstop, the runner is thereupon bodily rebounded therefrom back along the lane in the opposite direction toward the other of said locations at a speed substantially that at which he struck the panel.

2. The combination of claim 1 wherein the frame includes an inverted generally U-shaped structure forming frame top and spaced frame side members, the panel being attached as aforesaid only to said top and side frame members, and wherein said face of the panel struck by a runner as aforesaid forms an included angle with the lane of more than 90°.

3. The combination of claim 1 including another one of said backstops disposed as aforesaid at said other location.

4. The combination of claim 3 wherein the distance between said locations is in excess of abut 40 feet.

5. The combination of claim 4 wherein the frame of each of said backstops includes an inverted generally U-shaped structure forming frame top and spaced frame side members, the panel being attached as aforesaid only to said top and side frame members, and wherein said face of the panel struck by a runner as aforesaid forms an included angle with the lane of more than 90°.

6. The combination of claim 5 including at least one barrier disposed in the lane transversely thereof and intermediate the two backstops, the barrier being effective to be hurdled by runners along the lane.

7. The combination of claim 5 including a plurality of pairs of said backstops, the distance between respective pairs of the backstops defining a plurality of said lanes each substantially equal in length to the distance between said locations.

8. The combination of claim 7 wherein the backstops and lanes are disposed in adjacent, side-by-side relation.

9. Apparatus for use within a confined floor area for running a first distance longer than a second distance between two locations within the floor area by reciprocally traversing the second distance two or more times along a lane defined by an unsuspended surface within the floor area between said locations, each such apparatus comprising: a backstop including an inverted generally U-shaped frame having members forming the spaced sides and the top thereof; a flexible panel hving an operative face, the panel being suspended witin the frame by resilient means, said resilient means functioning to aid in rebounding a runner and being attached to and between edges of the panel and the frame side and top members only; and means for mounting the backstop so that the panel is disposed in an upright position and the backstop frame is restrained against movement, the panel being effective then so angled with a floor that when said face thereof is struck by an upright portion of the body of a runner running in one direction toward the backstop, the runner is thereupon bodily rebounded therefrom back in the opposite direction at substantially the same speed at which he struck the panel.

10. The apparatus of claim 9 wherein the means for mounting the backstop as aforesaid includes means to adjust the inclination of the backstop frame, and including brace means extending rearwardly of said operative panel face and between the lower ends of the frame side members effective to maintain such side members in spaced relation.

* * * * *